US007108724B2

(12) United States Patent
Shuku et al.

(10) Patent No.: US 7,108,724 B2
(45) Date of Patent: Sep. 19, 2006

(54) ANTI-PILLING TREATING METHOD FOR PROTEIN FIBER MATERIAL

(75) Inventors: Kiyokazu Shuku, Nara (JP); Hiromi Kashihara, Nara (JP)

(73) Assignee: Okamoto Corporation, Nara (JP)

( * ) Notice: Subject to any disclaimer, the term of this patent is extended or adjusted under 35 U.S.C. 154(b) by 219 days.

(21) Appl. No.: 10/748,157

(22) Filed: Dec. 31, 2003

(65) Prior Publication Data

US 2004/0261189 A1 Dec. 30, 2004

(30) Foreign Application Priority Data

Jun. 27, 2003 (JP) ..... 2003-184699

(51) Int. Cl.
*D06M 13/358* (2006.01)

(52) U.S. Cl. ..... 8/127.6

(58) Field of Classification Search ..... 8/127.6
See application file for complete search history.

(56) References Cited

U.S. PATENT DOCUMENTS 4,680,384 A * 7/1987 Seitz et al. ..... 534/622

FOREIGN PATENT DOCUMENTS

| | | |
|---|---|---|
| JP | 9-78451 | 3/1997 |
| JP | 3121377 B2 * | 12/2000 |
| JP | 2002-138369 | 5/2002 |

* cited by examiner

*Primary Examiner*—Margaret Einsmann
(74) *Attorney, Agent, or Firm*—Wenderoth, Lind & Ponack, L.L.P.

(57) ABSTRACT

An anti-pilling treating method is proposed in which protein fiber materials that are constant in quality and have sufficient softness and drape can be stably manufactured. Protein fiber is subjected to cross-linking reaction under weak alkaline conditions of pH 8.5–9.9 at the beginning of the reaction and pH 7.0–7.9 at the end of the reaction by use of a cross-linking agent containing 1 wt % or over of one or more of pyrimidine compound selected from the group consisting of 2,4,6-trichloropyrimidine, 2,6-dichloropyrimidine, 2,6-dichloro-4-aminopyrimidine, 4,6-dichloropyrimidine and 2-amino-4,6 dichloropyrimidine.

4 Claims, No Drawings

ANTI-PILLING TREATING METHOD FOR PROTEIN FIBER MATERIAL

BACKGROUND OF THE INVENTION

This invention relates to an anti-pilling treating method for protein fiber material to prevent the development of pilling on protein fiber products such as silk and animal hair.

Generally, fiber materials are terms that comprehensively refer to fibers, intermediate products of thread, threads and fabrics. Protein fiber materials include wools such as Merino wool, lamb wool, Angora wool, cashmere, alpaca, mohair and camel, and animal hair and silk. They are superior in heat retainability and stretchability, have hygroscopicity in spite of the fact that they are water-repellent, and are less likely to be deformed since they are elastic and recoverable even if deformed. Thus they have preferable properties as woven fabrics and materials for garments.

With fiber products made of such protein fiber materials, if friction or shock is applied to fibers while wearing, short fibers or micro-fibers that form thread float up from the thread surface and tend to get tangled together, thus developing pillings. This may impair the appearance of garment products.

As a conventional anti-pilling treatment method for protein fiber materials, a method is known in which 2,6-dichloro-4-hydroxy-S-triazine or its salt is used as a treating agent (JP patent publication 2002-138369).

As a treating method for fiber (such as wool) products, a method is known in which using as a cross-linking agent a compound having a trichloropyrimidine group or a dichloropyrimidine group and anion activated groups and having aryl groups as its matrix, main and side chains of protein fiber are coupled together to form an intricate network structure to improve the form stability such as wrinkle resistance, stretchability and shrink resistance (JP patent publication 9-78451).

But in the first anti-pilling treating method using a triazine compound, since a triazine compound tends to be hydrolyzed, it is not easy to obtain fibers that have constant quality by stable treatment. Thus this method requires a high level of treating technique.

Also, in the second method, since the molecular weight of the cross-linking agent is large, it is difficult to obtain a drape having sufficient softness for the treated fiber. Thus it is difficult to manufacture fiber products of high quality.

Also, with a treating method of which the main object is to prevent felting or shrinkage, even though a weak anti-pilling effect may be accidentally obtained, pilling resistance of about level 5 in a pilling test with the method under JIS L1076 cannot be reliably obtained.

For reference, there is an anti-pilling treating method which can be used for cellulose fibers. But since fibers are damaged, this method cannot be used for protein fiber materials.

An object of this invention is to provide an anti-pilling treating method by which fiber materials that are constant in quality by stable treatment and have sufficient softness and drape can be obtained, and which provides superior pilling resistance so that high-quality protein fiber materials having pilling resistance can be stably manufactured.

SUMMARY OF THE INVENTION

According to this invention, there is provided an anti-pilling treating method for protein fiber material, comprising the step of subjecting protein fiber to intermolecular cross-linking reaction under weak alkaline conditions in a treating bath comprising a cross-linking agent containing a pyrimidine compound which is dichloropyrimidine or trichloropyrimidine.

In the treating method described above, while a pyrimidine compound comprising dichloropyrimidine or trichloropyrimidine is used as a cross-linking agent, since pyrimidine compounds are less likely to be hydrolyzed compared to triazine compounds, a fiber material having stable quality is obtained by stable treatment.

Also, since the cross-linking agent used is small in the molecular weight, drape having sufficient softness is obtained for the treated fiber, so that it is possible to manufacture high-quality textile.

As the pyrimidine compound as the cross-linking agent, one or more pyrimidine compounds selected from the group consisting of 2,4,6-trichloropyrimidine, 2,6-dichloropyrimidine, 2,6-dichloro-4-aminopyrimidine, 4,6-dichloropyrimidine and 2-amino-4,6 dichloropyrimidine may be used.

In order to reliably achieve the above-described object, it is preferable that the amount of the pyrimidine compound used for the intermolecular cross-linking reaction is 1 wt % or over, preferably 1–8 wt %. Also, for the cross-linking reaction under weak alkaline conditions, pH should be 8.5–9.9 at the beginning of the reaction and 7.0–7.9 at the end of the reaction.

The anti-pilling treating method using such means will impart superior pilling resistance to the protein fiber material without deteriorating it.

DETAILED DESCRIPTION OF THE PREFERRED EMBODIMENT

Protein fiber materials to be processed in this invention include protein fibers, intermediate products of thread, threads, and fabrics, and they may be single fiber products or mixed fiber products. Also, they may be composite fiber materials including so-called synthetic fiber, if their major component is protein fiber material such as wool, other animal hair or silk.

As specific examples of animal hair, as described above, Merino wool, lamb wool, Angora wool, cashmere, alpaca, mohair and camel, etc. can be cited.

In the case of animal fiber, the use of a material of which the major component is off-scale fiber in which scales have been removed is preferable. By using off-scale fiber, the reactivity of the treatment according to this invention will improve, and the anti-pilling effect will stabilize. Also, a secondary effect that the shrink resistance improves is obtained.

As the pyrimidine compound used in this invention, one or more pyrimidine compounds selected from the group consisting of 2,4,6-trichloropyrimidine, 2,6-dichloropyrimidine, 2,6-dichloro-4-aminopyrimidine, 4,6-dichloropyrimidine and 2-amino-4,6-dichloropyrimidine may be used. Their amount in a treating bath is preferably 1–8 wt %. If the amount is less than 1 wt %, as shown in the below-described Comparative Example 3, sufficient pilling resistance would not be obtained. Also, if more than 8 wt %, the cross-linking agent would be excessively supplied and remain unreacted. This is a waste of reaction agents.

Preferable treating conditions for the anti-pilling treating method will be shown as an example. Firstly the bath rate is set at 1:5–20 with the initial treating bath kept at 25–85° C., a non-ion-family surfactant is added by 1–5 wt % relative to the fiber weight while circulating water in the treating bath.

Next, anhydrous sodium sulfate is added by 10–100 g/L, and the bath is held while circulating for 5–10 minutes.

Next, a derivative of 2,4,6-trichloropyrimidine or dichloropyrimidine is added by 1–8 wt % as a cross-linking agent, and sodium carbonate is added by 2–7 wt %, and the treating bath is held for 5–10 minutes while circulating. The PH at this time is set at 8.5–9.9. Next, it is held for 20–60 minutes at 85–100° C. The PH at the end of reaction is set at 7.0–7.9. Thereafter, by carrying out slow cooling, rinsing and soaping, the anti-pilling treatment will complete.

By improving the pilling properties of protein fiber material in this way, the wear resistance of the protein fiber material also improves, so that added values and functional property will improve, and drape also improves for comfortable use and its application may expand.

EXAMPLES AND COMPARATIVE EXAMPLES

The treated threads and the cross-linking agents and pH values used in the anti-pilling treatments in Examples and Comparative Examples are all shown in Table 1. Details of the respective Examples will be described below.

Example 1

1 kg of cheese winding of 2/48 off-scale wool yarn that has been subjected to refining was put on a cheese dyeing machine for 1 kg test, and its treating bath temperature was raised to 30° C. and the bath ratio was set to 1:12.

While circulating water at 30° C. in the treating bath, a non-ionic high-molecular surfactant (made by Osaka Chemical Industry: WX-3) was added by 3 wt % relative to the fiber. Then, anhydrous sodium sulfate was added by 50 g/l, and the bath was held for 5 minutes while circulating. Next, 2,4,6-trichloropyridine was added by 3 wt %, held for 10 minutes while circulating. Then, sodium carbonate was added by 5.5 wt %, and was held for 10 minutes. The pH at this time was 9.5. Thereafter, the temperature was raised to 95° C. at a rate of 1° C./min, and it was held for 30 minutes. The pH at the end was 7.8. Next, the fiber was subjected to slow cooling to 70° C., and the treating liquid was discharged. Rinsing was repeated three times, and hot water rinsing was carried out for 10 minutes at 60° C. Thereafter, rinsing was carried out three times to finish the treatment. Thereafter, ordinary dyeing steps were carried out to manufacture yarn subjected to anti-pilling treatment.

The yarn obtained was plain-knitted to obtain a protein fiber material of Example 1. Using the knitted fabric of Example 1, a pilling test (using JIS L1076 ICI type tester) was conducted to evaluate the pilling resistance. The results are shown in Table 2.

TABLE 1

| | Treated yarn 2/48 wool | Cross-linking agent | Initial pH | Final pH |
|---|---|---|---|---|
| Ex. 1 | off-scale | 2,4,6-trichloropyrimidine 3% | 9.5 | 7.8 |
| Ex. 2 | off-scale | 2-amino-4,6-dichloropyrimidine 3% | 9.4 | 7.6 |
| Ex. 3 | with scale | 2,4,6-trichloropyrimidine 5% | 9.8 | 7.8 |
| Comp. ex. 1 | off-scale | — | — | — |
| Comp. ex. 2 | with scale | — | — | — |
| Comp. ex. 3 | off-scale | 2,4,6-trichloropyrimidine 0.5% | 9.6 | 7.8 |
| Comp. ex. 4 | off-scale | 2,4,6-trichloropyrimidine 3% | 11.5 | 10.8 |
| Comp. ex. 5 | off-scale | 2-amino-4,6-dichloropyrimidine 3% | 11.3 | 10.5 |
| Comp. ex. 6 | with scale | 2,4,6-trichloropyrimidine 5% | 11.8 | 10.6 |

TABLE 2

| | pilling test results | Evaluation of drape |
|---|---|---|
| Ex. 1 | class 5 | good in feel and appearance |
| Ex. 2 | class 5 | good in feel and appearance |
| Ex. 3 | class 5 | good in feel and appearance |
| Comp. ex. 1 | class 2.5 | no problem for wearing |
| Comp. ex. 2 | class 3 | no problem for wearing |
| Comp. ex. 3 | class 4 | no problem for wearing |
| Comp. ex. 4 | — | — |
| Comp. ex. 5 | — | — |
| Comp. ex. 6 | — | — |

Example 2

1 kg of cheese winding of 2/48 off-scale wool yarn that has been subjected to refining was put on a cheese dyeing machine for 1 kg test, and its treating bath temperature was raised to 85° C. and the bath ratio was set to 1:12.

While circulating water at 85° C. in the treating bath, a non-ionic high-molecular surfactant (made by Osaka Chemical Industry: WX-3) was added by 3 wt % relative to the fiber. Next, anhydrous sodium sulfate was added by 50 g/l, and the bath was held for 5 minutes while circulating. Next, 2-amino-4,6-dichloropyridine was added by 3 wt %, held for 10 minutes while circulating. Next, sodium carbonate was added by 2.5 wt %, and was held for 10 minutes. The pH at this time was 9.4.

Thereafter, the temperature was raised to 98° C. at a rate of 1° C./min, and it was held for 45 minutes. The pH at the end of reaction was 7.6. Thereafter, it was subjected to slow cooling to 70° C., and the treating liquid was discharged. Rinsing was repeated three times, and then hot water rinsing was carried out for 10 minutes at 60° C. Thereafter, rinsing was carried out three times to finish the treatment. Further, ordinary dyeing steps were carried out to finish the anti-pilling treatment.

The yarn obtained was plain-knitted to obtain a protein fiber material of Example 2. Using the knitted fabric of Example 2, a pilling test (using JIS L1076 ICI type tester) was conducted to evaluate the pilling resistance. The results are shown in Table 2.

Example 3

1 kg of cheese winding of 2/48 off-scale wool yarn that has been subjected to refining was put on a cheese dyeing machine for 1 kg test, and its treating bath temperature was raised to 30° C. and the bath ratio was set to 1:12.

While circulating water at 30° C. in the treating bath, a non-ionic high-molecular surfactant (made by Osaka Chemical Industry: WX-3) was added by 3 wt % relative to the fiber. Next, anhydrous sodium sulfate was added by 100 g/l, and it was held for 5 minutes while circulating. Next, 2,4,6-trichloropyridine was added by 5 wt %, held for 10 minutes while circulating. Next, sodium carbonate was added by 6.0 wt %, and was held for 10 minutes. The pH at this time was 9.8. Thereafter, the temperature was raised to 95° C. at a rate of 1° C./min, and it was held for 45 minutes. The pH at the end was 7.8. Thereafter, it was subjected to slow cooling to 70° C., and the treating liquid was discharged. Rinsing was repeated three times, and hot water rinsing was carried out for 10 minutes at 60° C. Thereafter, rinsing was carried out three times to finish the treatment. Further, ordinary dyeing steps were carried out to finish the anti-pilling treatment.

The yarn obtained was plain-knitted to obtain a protein fiber material of Example 3. Using the knitted fabric of Example 3, a pilling test (using JIS L1076 ICI type tester) was conducted to evaluate the pilling resistance. The results are shown in Table 2.

Comparative Example 1

1 kg of cheese winding of 2/48 off-scale wool yarn that has been subjected to refining was subjected to ordinary dyeing steps on a cheese dyeing machine for 1 kg test.

Using the yarn thus obtained, a knitted fabric was prepared in the same manner as in Example 1. Using this knitted fabric, a pilling test (using JIS L1076 ICI type tester) was conducted to evaluate the pilling resistance. The results are shown in Table 2.

Comparative Example 2

1 kg of cheese winding of 2/48 wool yarn with scales which has been subjected to refining was subjected to ordinary dyeing steps on a cheese dyeing machine for 1 kg test.

Using the yarn thus obtained, a knitted fabric was prepared in the same manner as in Example 1. Using this knitted fabric, a pilling test (using JIS L1076 ICI type tester) was conducted to evaluate the pilling resistance. The results are shown in Table 2.

Comparative Example 3

Except that 2,4,6-trichloropyrimidine was added by 0.5 wt %, yarn subjected to anti-pilling treatment was manufactured under the same conditions as in Example 1.

The yarn obtained was plain-knitted to obtain a protein fiber material of Comparative Example 3. Using this fabric, a pilling test (using JIS L1076 ICI type tester) was conducted to evaluate the pilling resistance. The results are shown in Table 2.

Comparative Example 4

Except that instead of sodium carbonate, caustic soda was added by 5 wt % to adjust the treating liquid so that its pH is 11.5, treatment was carried out under the same treating conditions as in Example 1. The pH at the end of reaction was 10.8.

With the yarn thus obtained, preparation of the same knitted fabric as in Example 1 was tried, but with vain because the yarn had deteriorated and the strength had lowered.

Comparative Example 5

Except that instead of sodium carbonate, caustic soda was added by 5 wt % to adjust the treating liquid so that its pH is 11.3, treatment was carried out under the same treating conditions as in Example 2. The pH at the end of reaction was 10.5.

With the yarn thus obtained, preparation of the same knitted fabric as in Example 1 was tried, but with vain because the yarn had deteriorated and the strength had lowered.

Comparative Example 6

Except that instead of sodium carbonate, caustic soda was added by 5 wt % to adjust the treating liquid so that its pH is 11.8, treatment was carried out under the same treating conditions as in Example 3. The pH at the end of reaction was 10.6.

With the yarn thus obtained, preparation of the same knitted fabric as in Example 1 was tried, but with vain because the yarn had deteriorated and the strength had lowered.

As will be apparent from the results of Table 2, for the protein fiber materials of Examples 1–3, the pilling resistance was superior, so that the pilling test results under JIS L1076 were all level 5.

Also, with the treating method of this invention, as shown in Examples 1–3, since the pH of the final treating liquid is in the range of 7.0–7.9, it would not incur deterioration of the protein fiber material. It is sufficiently practical.

Thus, unlike fiber materials having weak pilling resistance which are obtained by conventional treating methods in which the object is to prevent felting and shrinkage, a fiber material having superior pilling resistance can be obtained. Thus, the functional property of such a protein fiber material improves, and it is possible to extend its application not only for general garments but for socks and sporting garments which tend to suffer from the formation of pilling.

Also, since the anti-pilling treating method of this invention needs no special facility and the processing cost is relatively inexpensive, it is superior from an economical viewpoint. Thus, this method has an extremely high practical value.

As described above, this invention provides an anti-pilling treating method in which a protein fiber material is subjected to cross-linking reaction using a cross-linking agent containing a pyrimidine compound comprising dichloropyrimidine or trichloropyrimidine under weak alkaline conditions. Thus it is possible to carry out stable high-quality treatment and the quality is stable. Also, the treated protein fiber material has sufficient softness and drape and superior pilling resistance.

What is claimed is:

1. An anti-pilling treating method for protein fiber material comprising the step of subjecting protein fiber to intermolecular cross-linking reaction under weak alkaline conditions in a treating bath comprising a cross-linking agent containing 1 to 8 wt % of a pyrimidine compound which is dichloropyrimidine or trichloropyrimidine wherein the pyrimidine ring is optionally substituted with amino.

2. The anti-pilling treating method for protein fiber material as claimed in claim 1 wherein said pyrimidine compound is one or more selected from the group consisting of 2,4,6-trichloropyrimidine, 2,6-dichloropyrimidine, 2,6-dichloro-4-aminopyrimidine, 4,6-dichloropyrimidine and 2-amino-4,6 dichloropyrimidine.

3. The anti-pilling treating method for protein fiber material as claimed in claim 1 wherein said weak alkaline conditions mean that the pH of the treating bath is 8.5–9.9 at the beginning of the reaction and 7.0–7.9 at the end of the reaction.

4. The anti-pilling treating method for protein fiber material as claimed in claim 2 wherein said weak alkaline conditions mean that the pH of the treating bath is 8.5–9.9 at the beginning of the reaction and 7.0–7.9 at the end of the reaction.

* * * * *